US011837388B2

(12) United States Patent
Kang et al.

(10) Patent No.: US 11,837,388 B2
(45) Date of Patent: Dec. 5, 2023

(54) COIL COMPONENT

(71) Applicant: SAMSUNG ELECTRO-MECHANICS CO., LTD., Suwon-si (KR)

(72) Inventors: Byung Soo Kang, Suwon-si (KR); Ju Hwan Yang, Suwon-si (KR); Byeong Cheol Moon, Suwon-si (KR); Yoon Mi Cha, Suwon-si (KR); Mi Geum Kim, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 850 days.

(21) Appl. No.: 16/573,319

(22) Filed: Sep. 17, 2019

(65) Prior Publication Data

US 2020/0152370 A1 May 14, 2020

(30) Foreign Application Priority Data

Nov. 13, 2018 (KR) ..... 10-2018-0138612

(51) Int. Cl.
*H01F 27/28* (2006.01)
*H01F 27/29* (2006.01)
(Continued)

(52) U.S. Cl.
CPC ..... *H01F 27/2804* (2013.01); *H01F 27/255* (2013.01); *H01F 27/29* (2013.01);
(Continued)

(58) Field of Classification Search
CPC ..... H01F 17/06; H01F 27/08; H01F 27/255; H01F 41/041; H01F 17/04
(Continued)

(56) References Cited

U.S. PATENT DOCUMENTS 6,213,109 B1 * 4/2001 Satoo ..... H01F 38/12 336/107
8,390,415 B2 3/2013 Ogawa et al.
(Continued)

FOREIGN PATENT DOCUMENTS

JP 2012-234867 A 11/2012
KR 10-2016-0014523 A 2/2016
(Continued)

OTHER PUBLICATIONS

Office Action dated Aug. 18, 2023 for corresponding Korean Patent Application No. 10-2018-0138612 (See English translation).

*Primary Examiner* — Shawki S Ismail
*Assistant Examiner* — Kazi S Hossain
(74) *Attorney, Agent, or Firm* — Morgan, Lewis & Bockius LLP

(57) ABSTRACT

A coil component includes a body including magnetic metal powder particles and an insulating resin; a coil portion embedded in the body; and first and second external electrodes respectively disposed on the body to be spaced apart from each other and respectively connected to both end portions of the coil portion. A magnetic metal powder particle exposed from a surface of the body, among the magnetic metal powder particles, has a plating prevention film formed on at least a portion of a surface thereof and containing metal ions of the exposed magnetic metal powder particle.

18 Claims, 4 Drawing Sheets

(51) Int. Cl.
*H01F 41/04* (2006.01)
*H01F 41/12* (2006.01)
*H01F 27/255* (2006.01)

(52) U.S. Cl.
CPC ..... *H01F 41/041* (2013.01); *H01F 41/122* (2013.01); *H01F 2027/2809* (2013.01)

(58) Field of Classification Search
USPC ..... 336/200, 232, 192, 198
See application file for complete search history.

(56) References Cited

U.S. PATENT DOCUMENTS 9,704,640 B2 7/2017 Choi et al.
9,728,316 B2 8/2017 Mimura et al.
10,892,084 B2 1/2021 Lee
2012/0274429 A1* 11/2012 Ogawa ..... H01F 1/26 335/299
2014/0145814 A1* 5/2014 Lee ..... H01F 17/0013 336/200
2015/0287507 A1* 10/2015 Nishio ..... H01F 3/08 335/297
2016/0035476 A1* 2/2016 Mimura ..... H01F 41/046 336/199
2016/0055955 A1* 2/2016 Park ..... H01F 27/255 336/83
2016/0086716 A1* 3/2016 Choi ..... H01F 17/0013 427/127
2016/0276089 A1* 9/2016 Inoue ..... H01F 17/0033
2018/0137965 A1* 5/2018 Lee ..... H01F 17/0033
2018/0166198 A1* 6/2018 Kim ..... H01F 17/0033
2019/0189340 A1* 6/2019 Kim ..... H01F 3/08

FOREIGN PATENT DOCUMENTS

KR 10-2016-0033463 A 3/2016
KR 10-2016-0040422 A 4/2016
KR 10-2018-0054266 A 5/2018

* cited by examiner

COIL COMPONENT

CROSS-REFERENCE TO RELATED APPLICATION(S)

This application claims benefit of priority to Korean Patent Application No. 10-2018-0138612 filed on Nov. 13, 2018 in the Korean Intellectual Property Office, the disclosure of which is incorporated herein by reference in its entirety.

TECHNICAL FIELD

The present disclosure relates to a coil component.

BACKGROUND

An inductor, a coil component, may be a typical passive electronic component used in electronic devices, along with a resistor and a capacitor.

With higher performance and smaller sizes gradually implemented in electronic devices, the number of coil components used in electronic devices has been increasing and the sizes of the coil components have becoming smaller.

In the case of a thin film type inductor, a magnetic composite sheet including magnetic metal powder particles is stacked and cured on a substrate on which a coil portion is formed using a plating process, to form a body, and external electrodes are formed on a surface of the body.

In order to reduce thicknesses of the components, the external electrodes may be formed using a plating process. In this case, the magnetic metal powder particle exposed from the surface of the body may cause plating blur.

SUMMARY

An aspect of the present disclosure is to provide a coil component capable of preventing deteriorations of reliability due to plating blur in a plating process for forming external electrodes.

Another aspect of the present disclosure is to provide a coil component which may become lighter, thinner, shorter, and smaller.

According to an aspect of the present disclosure, a coil component includes a body including magnetic metal powder particles and an insulating resin; a coil portion embedded in the body; and first and second external electrodes respectively disposed on the body to be spaced apart from each other and respectively connected to both end portions of the coil portion. A magnetic metal powder particle exposed from a surface of the body, among the magnetic metal powder particles, has a plating prevention film disposed on at least a portion of the surface of the body and containing metal ions of the magnetic metal powder particles.

According to an aspect of the present disclosure, a coil component includes a body comprising a magnetic metal powder particle and an insulating resin; a coil portion embedded in the body; and first and second external electrodes respectively disposed on the body to be spaced apart from each other and respectively connected to both end portions of the coil portion. An oxide film is at least partially embedded in the body and covers only a portion of the magnetic metal powder particle.

BRIEF DESCRIPTION OF DRAWINGS

The above and other aspects, features, and advantages of the present disclosure will be more clearly understood from the following detailed description, taken in conjunction with the accompanying drawings, in which.

DETAILED DESCRIPTION

Figure 1:
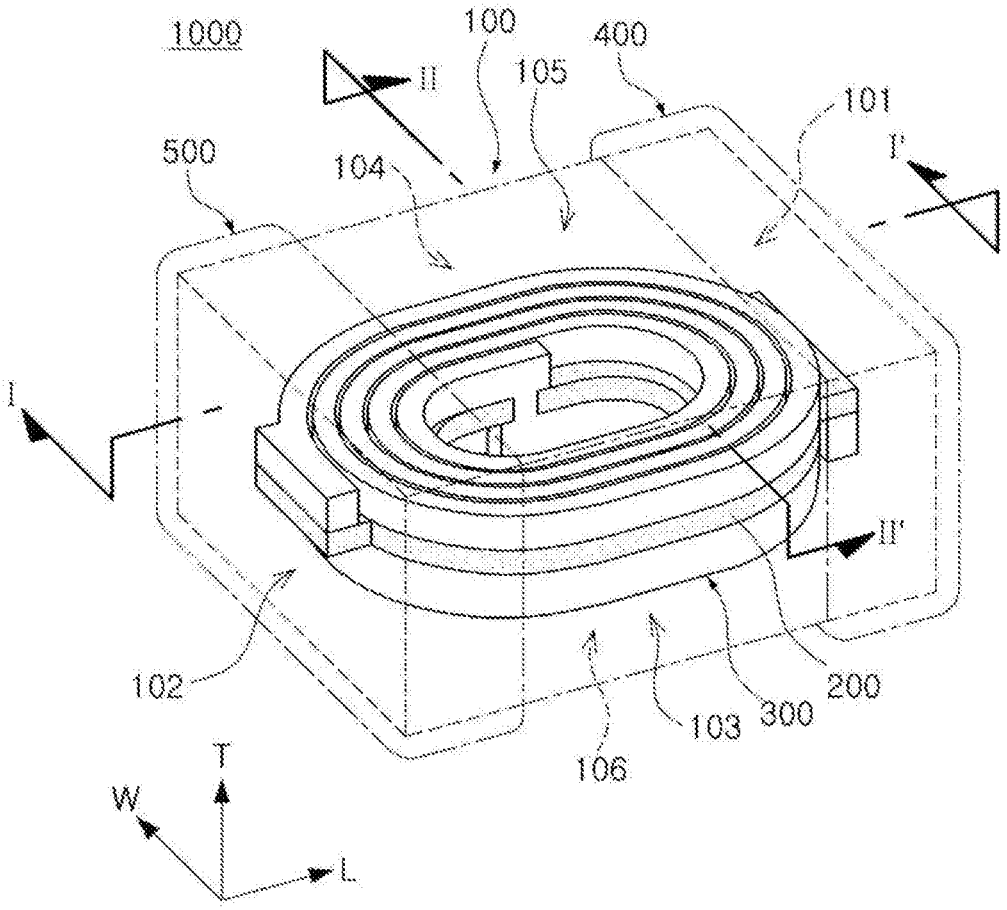
FIG. 1 is a schematic view illustrating a coil component according to an embodiment of the present disclosure.

The terms used in the description of the present disclosure are used to describe a specific embodiment, and are not intended to limit the present disclosure. A singular term includes a plural form unless otherwise indicated. The terms "include," "comprise," "is configured to," etc. of the description of the present disclosure are used to indicate the presence of features, numbers, steps, operations, elements, parts, or combination thereof, and do not exclude the possibilities of combination or addition of one or more additional features, numbers, steps, operations, elements, parts, or combination thereof. Also, the terms "disposed on," "positioned on," and the like, may indicate that an element is positioned on or beneath an object, and does not necessarily mean that the element is positioned above the object with reference to a gravity direction.

The term "coupled to," "combined to," and the like, may not only indicate that elements are directly and physically in contact with each other, but also include the configuration in which another element is interposed between the elements such that the elements are also in contact with the other component.

Sizes and thicknesses of elements illustrated in the drawings are indicated as examples for ease of description, and the present disclosure are not limited thereto.

In the drawings, an L direction is a first direction or a length (longitudinal) direction, a W direction is a second direction or a width direction, a T direction is a third direction or a thickness direction.

Hereinafter, a coil component according to an embodiment of the present disclosure will be described in detail with reference to the accompanying drawings. Referring to the accompanying drawings, the same or corresponding components may be denoted by the same reference numerals, and overlapped descriptions will be omitted.

In electronic devices, various types of electronic components may be used, and various types of coil components may be used between the electronic components to remove noise, or for other purposes.

In other words, in electronic devices, a coil component may be used as a power inductor, a high frequency (HF) inductor, a general bead, a high frequency (GHz) bead, a common mode filter, and the like.

Figure 2:
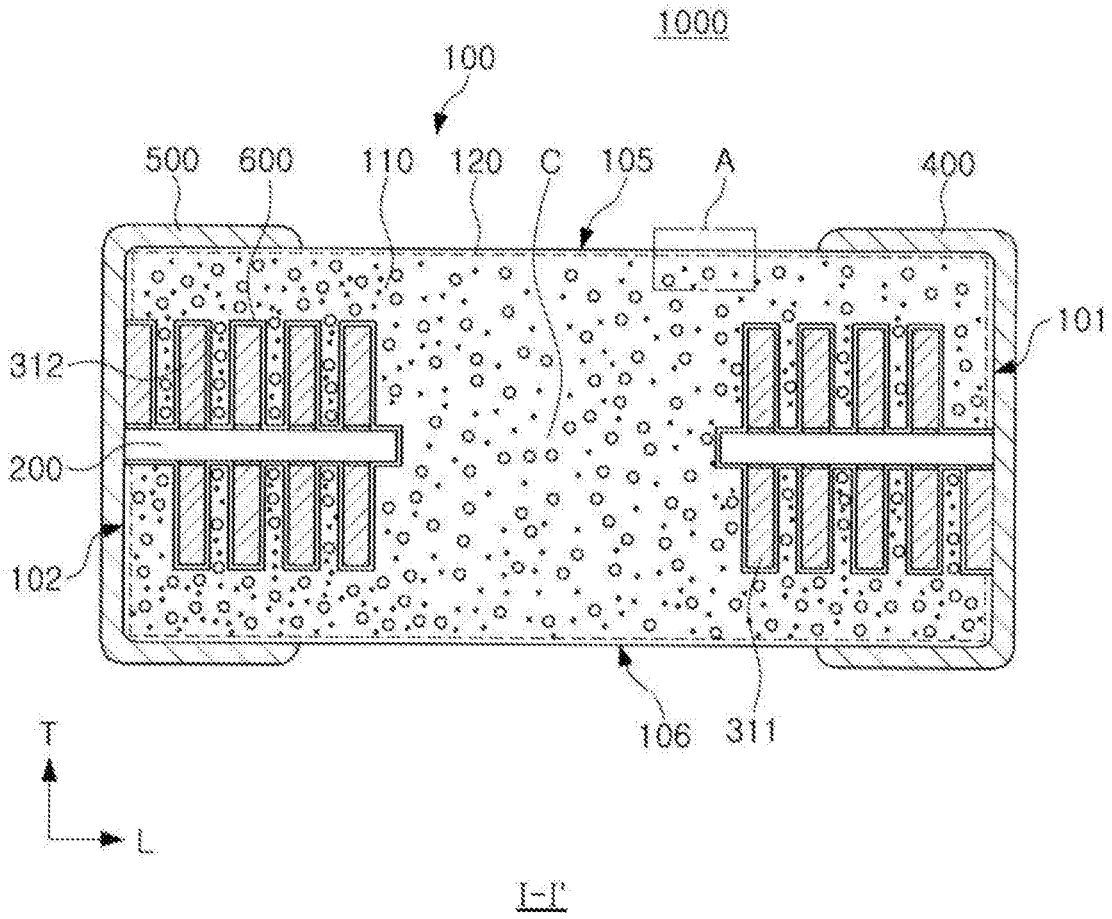
FIG. 2 is a cross-sectional view taken along line I-I' of FIG. 1.
Figure 3:
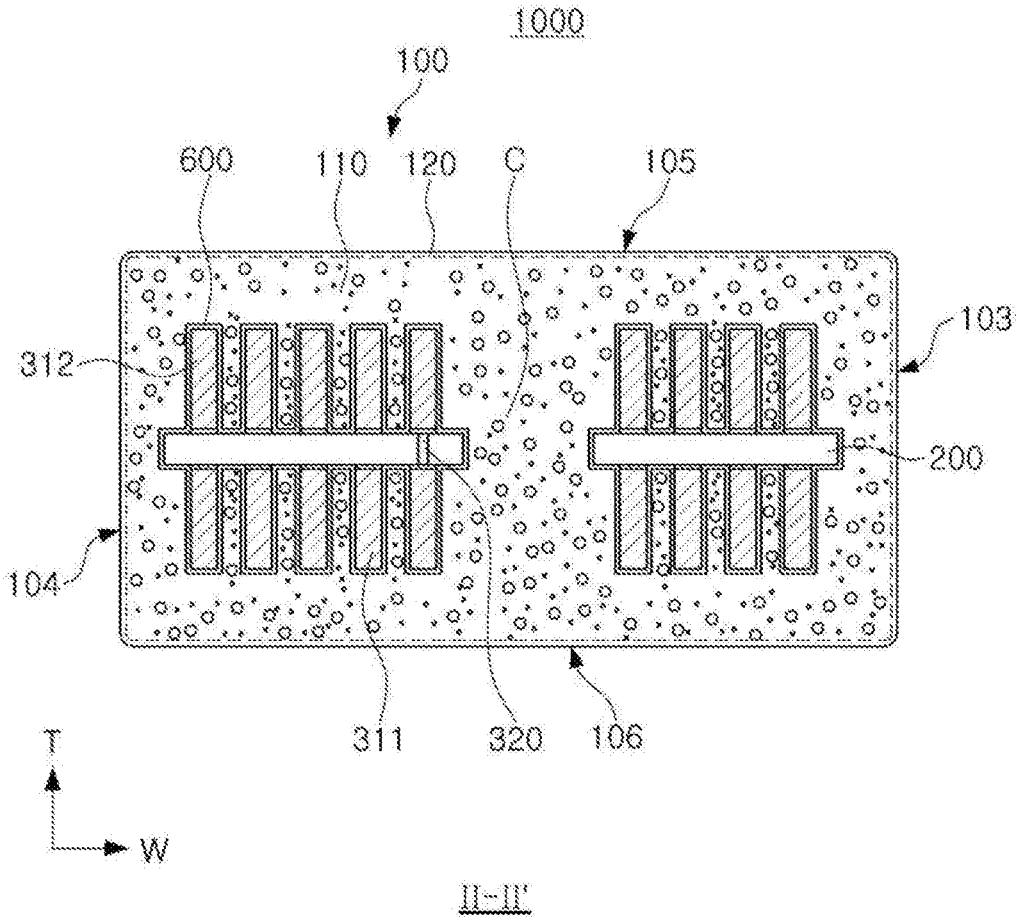
FIG. 3 is a cross-sectional view taken along line II-II' of FIG. 1.
Figure 4:
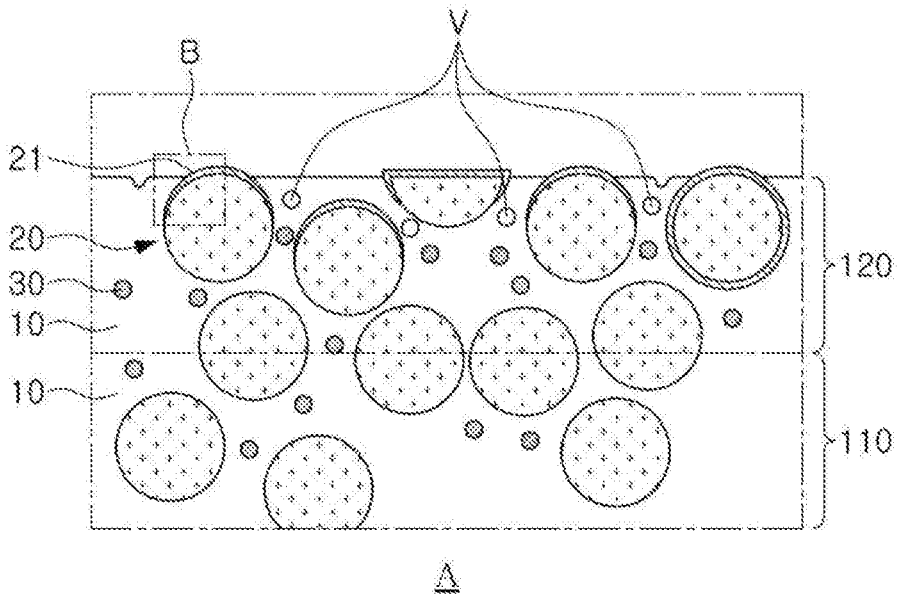
FIG. 4 is an enlarged view of portion A of FIG. 1.
Figure 5:
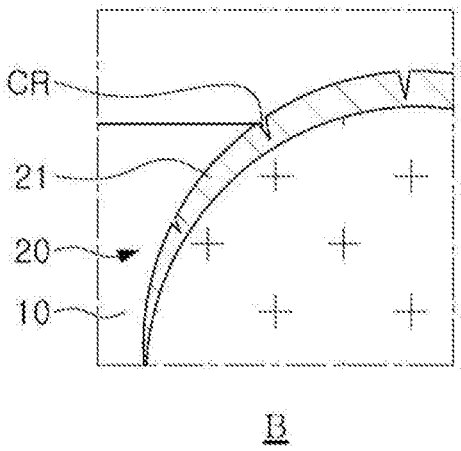
FIG. 5 is an enlarged view of portion B of FIG. 4.

FIG. 1 is a schematic view illustrating a coil component according to an embodiment of the present disclosure, FIG. 2 is a cross-sectional view taken along line I-I' in FIG. 1, FIG. 3 is a cross-sectional view taken along line II-II' in FIG. 1, FIG. 4 is an enlarged view of portion A in FIG. 1, and FIG. 5 is an enlarged view of portion B in FIG. 4.

Referring to FIGS. 1 to 5, a coil component 1000 according to an embodiment of the present disclosure may include a body 100, an inner insulation layer 200, a coil portion 300, external electrodes 400 and 500, and an insulation film 600.

The body 100 may form an exterior of the coil portion 1000 according to this embodiment, and the coil portion 300 may be embedded therein.

The body 100 may be formed in a hexahedral shape as a whole.

Referring to FIGS. 1 to 3, the body 100 may include a first surface 101 and a second surface 102 facing each other in a longitudinal direction L, a third surface 103 and a fourth surface 104 facing each other in a width direction W, and a fifth surface 105 and a sixth surface 106 facing each other in a thickness direction T. Each of the first to fourth surfaces 101, 102, 103, and 104 of the body 100 may correspond to wall surfaces of the body 100 connecting the fifth surface 105 and the sixth surface 106 of the body 100. Hereinafter, both end surfaces of the body 100 may refer to the first surface 101 and the second surface 102 of the body, and both side surfaces of the body 100 may refer to the third surface 103 and the fourth surface 104 of the body. Further, one surface and the other surface of the body 100 may refer to the sixth surface 106 and the fifth surface 105 of the body 100, respectively.

The body 100 may be formed such that the coil component 1000 according to this embodiment in which the external electrodes 400 and 500 to be described later are formed has a length of 2.0 mm, a width of 1.2 mm, and a thickness of 0.65 mm, but is not limited thereto.

The body 100 may include magnetic metal powder particles 20 and 30 and an insulating resin 10, and may have an internal portion 110 and an outer portion 120 surrounding the internal portion 110.

Specifically, the body 100 may be formed using stacking at least one magnetic composite sheet containing the insulating resin 10 and the magnetic metal powder particles 20 and 30 dispersed in the insulating resin 10.

The magnetic metal powder particles 20 and 30 may include at least one of iron (Fe), silicon (Si), chromium (Cr), cobalt (Co), molybdenum (Mo), aluminum (Al), niobium (Nb), copper (Cu), and nickel (Ni). For example, the magnetic metal powder particles 20 and 30 may be at least one or more of a pure iron powder, a Fe—Si-based alloy powder, a Fe—Si—Al-based alloy powder, a Fe—Ni-based alloy powder, a Fe—Ni—Mo-based alloy powder, a Fe—Ni—Mo—Cu-based alloy powder, a Fe—Co-based alloy powder, a Fe—Ni—Co-based alloy powder, a Fe—Cr-based alloy powder, a Fe—Cr—Si-based alloy powder, a Fe—Si—Cu—Nb-based alloy powder, a Fe—Ni—Cr-based alloy powder, and a Fe—Cr—Al-based alloy powder.

The magnetic metal powder particles 20 and 30 may be amorphous or crystalline. For example, the magnetic metal powder particles 20 and 30 may be a Fe—Si—B—Cr-based amorphous alloy powder, but are not limited thereto. The magnetic metal powder particles 20 and 30 may have an average diameter of 0.1 μm to 30 μm, respectively, but are not limited thereto.

The magnetic metal powder particles 20 and 30 may include a first powder particle 20 and a second powder particle 30 having a particle diameter smaller than a particle diameter of the first powder particle 20. In the present specification, the term "particle diameter" refers to a particle size distribution represented by $D_{90}$ or $D_{50}$. In the case of the present disclosure, since the magnetic metal powder particles 20 and 30 include the first powder particle 20 and the second powder particle 30 having a particle diameter smaller than that of the first powder particle 20, the second powder particle 30 may be disposed in a space between the first powder particles 20 to improve a filling ratio of the magnetic material in the body 100.

The insulating resin 10 may include an epoxy, a polyimide, a liquid crystal polymer, or the like, in a single form or in combined forms, but is not limited thereto.

The body 100 may include a magnetic core C passing through the coil portion 300 to be described later. The magnetic core C may be formed using filling through-holes of the coil portion 300 with the magnetic composite sheet, but is not limited thereto.

The outer portion 120 may surround the internal portion 110 by forming outer surfaces of the outer portion 120 as the first to sixth surfaces 101, 102, 103, 104, 105, and 106 of the body 100. The internal portion 110 and the outer portion 120 of the body 100 may not be formed as separate members. For example, the outer portion 120 may be a region of the body 100 corresponding to an invaded depth of an acid solution in an acid treatment, which will be described later, and may be described only to be distinguished from the internal portion 110. As a non-limiting example, the outer portion 120 may be defined as a depth of about 1.5 times than a particle size of the first powder particle 20, described above, from the surface of the body 100. As described above, the outer portion 120 of the present disclosure may be distinguished from the prior art in view of the fact that a separate insulation layer is not stacked or coated on the surface of the body 100, after the formation of the body 100.

The magnetic metal powder particles 20 and 30 disposed in the outer portion 120 may have a plating prevention film 21 on at least a portion of a surface of each of the magnetic metal powder particles 20 and 30. For example, the magnetic metal powder particles 20 and 30 exposed from the surface of the body 100, among the magnetic metal powder particles 20 and 30 disposed in the outer portion 120, may have a plating prevention film 21 on at least a portion of a surface of each of the magnetic metal powder particles 20 and 30. The magnetic metal powder particles 20 and 30 which may be covered with the insulating resin 10 and may be not exposed from the surface of the body 100, among the magnetic metal powder particles 20 and 30 disposed in the outer portion 120, may also have a plating prevention film 21 on at least a portion of a surface of each of the magnetic metal powder particles 20 and 30. The latter case may be because an acidic solution passes through to a boundary between the outer portion 120 and the internal portion 110 in the body 100 due to a porous structure of the insulating resin 10.

Since a particle diameter of the first powder particle 20 is greater than a particle diameter of the second powder particle 30, the plating prevention film 21 may be formed on a surface of the first powder particle 20 in general. For example, both the first powder particle 20 and the second powder particle 30 may be exposed from the surface of the body 100, but the second powder particle 30 exposed from the surface of the body 100 may be dissolved in an acidic solution during an acid treatment due to a relatively smaller particle diameter of the second powder particle 30. The second powder particle 30 may be dissolved in the acidic solution to form voids V in the insulating resin 10 of the outer portion 120. As a result, a volume of each of the voids V formed in the insulating resin 10 of the outer portion 120 may correspond to a volume of the second powder particle 30 remaining in the insulating resin 10 of the outer portion 120. As described above, since the particle diameter of the second powder particle refers to the particle diameter distribution, the volume of the second powder particle 30 means volume distribution. Therefore, the volume of the voids V corresponding to the volume of the second powder particle 30 refers that the volume distribution in the volume of the voids is substantially equal to the volume distribution in the volume of the second powder particle.

The plating prevention film 21 may be formed using reacting the magnetic metal powder particles 20 and 30 of the outer portion 120 with the acid. The plating prevention film 21 may include, or may be, an oxide of a metal magnetic component constituting the magnetic metal powder particles and be formed by oxidizing the magnetic metal powder particles 20 and 30 by the acid. Therefore, the plating prevention film 21 may be discontinuously formed on the surface of the body 100. That is, the plating prevention film 21 may be distributed on the surface of the body 100 according to a distribution of the magnetic metal powder particles 20 or a distribution of the magnetic metal powder particles 20 and 30 on the surface of the body 100. In addition, a concentration of oxygen ions in the plating prevention film 21 may be reduced toward a center of each of the magnetic metal powder particles 20 and 30 from the outside. For example, since the surface of each of the magnetic metal powder particles 20 and 30 is exposed to the acid solution for a period longer than that of the center of each of the magnetic metal powder particles 20 and 30, the concentration of oxygen ions in the plating prevention film 21 may vary, depending on a depth of the plating prevention film 21. As a result, cracks CR may be formed in the plating prevention film 21, due to unbalance of metal ions or the like by the oxidation-reduction reaction. The plating prevention film 21 of the present disclosure may be distinguished from an oxide film additionally applied or coated on a surface of a magnetic metal powder particle.

Since the plating prevention film 21 contains metal ions and oxygen ions of the magnetic metal powder particles 20 and 30, the plating insulation film 21 may be excellent in electrical insulation. Therefore, in forming a plating layer on the external electrodes 400 and 500 to be described later, a plating blurring phenomenon and the like may be prevented without forming a separate plating resist on the surface of the body 100.

The plating prevention film 21 may be formed on a cut surface of each of the magnetic metal powder particles 20 and 30. The cut surface may be a flat surface intersecting the curved outer surface of the remaining portion of the magnetic metal powder particle 20. The coil component 1000 according to this embodiment may form a plurality of unit coils on a substrate of a strip level or a panel level, may stack the magnetic composite sheets, and may then dice the substrate to individualize a plurality of components. In this case, a dicing tip may cut the plurality of components along a dicing line, and the magnetic metal powder particles 20 and 30 arranged on the dicing line may be cut by the dicing tip, to have the cut surface. For the above reason, the cut surface of the magnetic metal powder particles 20 and 30 may be exposed from the surface of the body 100, and the plating prevention film 21 may be formed on the cut surface by the acid treatment.

A thickness of the plating prevention film 21 on one of the magnetic metal powder particles 20 and 30 may decrease in a direction from the surface of the body 100 to an inner portion of the body 100. For example, the thickness of the plating prevention film 21 on one of the magnetic metal powder particles 20 and 30 may decrease in a direction substantially perpendicular to the surface of the body 100. In one example, the plating prevention film 21 may cover a first portion of one of the magnetic metal powder particles 20 and 30 and may not cover a second portion of the one of the magnetic metal powder particles 20 and 30 which is farther away from the surface as compared to the first portion. A thickness of the plating prevention film 21 may be 3 nm or more and 20 μm or less. Here, the thickness of the plating prevention film 21 of 3 nm or more and 20 μm or less may refer to a thickness of the plating prevention film 21 on a portion of one of the magnetic metal powder particles 20 and 30 facing the surface of the body or exposed from the body. When the thickness of the plating prevention film is less than 3 nm, the electrical insulation properties of the plating prevention film 21 may be poor. When the thickness of the plating prevention film is more than 20 μm, the magnetic properties of the first powder particle 20 may be deteriorated.

As illustrated in FIG. 4, the plating prevention film 21 may be formed on the entire surface of any one of the magnetic metal powder particles 20 and 30 disposed on the outer portion 120, or may be formed only on a region of any one of the magnetic metal powder particles 20 and 30.

The inner insulation layer 200 may be embedded in the body 100. The inner insulation layer 200 may be configured to support the coil portion 300 to be described later.

The inner insulation layer 200 may be formed of an insulating material including a thermosetting insulating resin such as an epoxy resin, a thermoplastic insulating resin such as polyimide, or a photosensitive insulating resin, or may be formed of an insulating material in which a reinforcing material such as a glass fiber or an inorganic filler is impregnated with such an insulating resin. For example, the inner insulation layer 200 may be formed of an insulating material such as prepreg, Ajinomoto Build-up Film (ABF), FR-4, a bismaleimide triazine (BT) resin, a photoimageable dielectric (PID), and the like, but are not limited thereto.

As the inorganic filler, at least one or more selected from a group consisting of silica ($SiO_2$), alumina ($Al_2O_3$), silicon carbide (SiC), barium sulfate ($BaSO_4$), talc, mud, a mica powder, aluminium hydroxide ($Al(OH)_3$), magnesium hydroxide ($Mg(OH)_2$), calcium carbonate ($CaCO_3$), magnesium carbonate ($MgCO_3$), magnesium oxide (MgO), boron nitride (BN), aluminum borate ($AlBO_3$), barium titanate ($BaTiO_3$), and calcium zirconate ($CaZrO_3$) may be used.

When the inner insulation layer 200 is formed of an insulating material including a reinforcing material, the inner insulation layer 200 may provide better rigidity. When the inner insulation layer 200 is formed of an insulating material not containing glass fibers, the inner insulation layer 200 may be advantageous for reducing a thickness of the overall coil portion 300. When the inner insulation layer 200 is formed of an insulating material containing a photosensitive insulating resin, the number of processes for forming the coil portion 300 may be reduced. Therefore, it may be advantageous in reducing production costs, and a fine via may be formed.

The coil portion 300 may be embedded in the body 100 to manifest the characteristics of the coil portion. For example, when the coil component 1000 of this embodiment is used as a power inductor, the coil portion 300 may function to stabilize the power supply of an electronic device by storing an electric field as a magnetic field and maintaining an output voltage.

The coil portion 300 may be formed on at least one of both surfaces of the inner insulation layer 200, and may form at least one turn. In this embodiment, the coil portion 300 may include first and second coil patterns 311 and 312 formed on both surfaces of the inner insulation layer 200 opposing each other in the thickness direction T of the body 100, and a via 320 passing through the inner insulation layer 200 to connect the first and second coil patterns 311 and 312 to each other.

Each of the first coil pattern 311 and the second coil pattern 312 may have a spiral planar shape forming at least one turn with reference to the magnetic core C. For example, the first coil pattern 311 may form at least one turn with reference to the magnetic core C on a lower surface of the inner insulation layer 200, and the second coil pattern 312 may form at least one turn with reference to the magnetic core C on an upper surface of the inner insulation layer 200, based on the direction of FIG. 2 or FIG. 3.

End portions of the first and second coil patterns 311 and 312 may be connected to the first and second external electrodes 400 and 500, respectively, which will be described later. For example, the end portions of the first coil pattern 311 may be connected to the first external electrode 400, and the end portions of the second coil pattern 312 may be connected to the second external electrode 500.

As an example, the end portions of the first coil pattern 311 may extend to be exposed from the first surface 101 of the body 100, and the end portions of the second coil pattern 312 may extend to be exposed from the second surface 102 of the body 100, to be in contact with and be connected to the first and second external electrodes 400 and 500, formed on the first and second surfaces 101 and 102 of the body 100, respectively. In this case, each of the coil patterns 311 and 312 including the end portions may be integrally formed.

As another example, the first and second coil patterns 311 and 312 and the first and second external electrodes 400 and 500 may be connected to each other by connection electrodes. For example, holes may be formed on a side of the sixth surface 106 of the body 100 to expose the end portions of the first and second coil patterns 311 and 312, the holes may be filled with a conductive material to form the connection electrodes, and the first and second external electrodes 400 and 500 may be disposed on the sixth surface 106 of the body 100 to cover the connection electrode. In this case, a boundary may be formed between each of the coil patterns 311 and 312 and the connection electrode.

At least one of the coil patterns 311 and 312, and the via 320 may include at least one conductive layer.

For example, when the second coil pattern 312 and the via 320 are formed on a side of the other surface of the inner insulation layer 200 by a plating process, the second coil pattern 312 and the via 320 may be formed using a seed layer of electroless plating layers, or the like, and an electroplating layer. In this case, each of the seed layer and the electroplating layer may have a single-layer structure or a multilayer structure. The electroplating layer of the multilayer structure may be formed using a conformal film structure in which one electroplating layer is covered by another electroplating layer, and another electroplating layer is stacked on only one side of the one electroplating layer, or the like. The seed layer of the second coil pattern 312 and the seed layer of the via 320 may be integrally formed, and no boundary therebetween may occur, but are not limited thereto. The electroplating layer of the second coil pattern 312 and the electroplating layer of the via 320 may be integrally formed, and no boundary therebetween may occur, but are not limited thereto.

As another example, referring to FIGS. 2 and 3, when the first coil pattern 311 disposed on a side of the lower surface of the inner insulation layer 200 and the second coil pattern 311 disposed on a side of the upper surface of the inner insulation layer 200 are separately formed, and are then stacked on the inner insulation layer 200 in a batch, the via 320 may include a high melting point metal layer, and a low melting point metal layer having a melting point lower than a melting point of the high melting point metal layer. In this case, the low melting point metal layer may be formed of a solder containing lead (Pb) and/or tin (Sn). The low melting point metal layer may be melted at least in part due to the pressure and the temperature at the time of stacking in a batch. As a result, an intermetallic compound (IMC) layer may be formed at least at a portion of a boundary between the low melting point metal layer and the second coil pattern 312, and a boundary between the low melting point metal layer and the high melting point metal layer.

The coil patterns 311 and 312 may protrude from both surfaces of the inner insulation layer 200, for example, as illustrated in FIGS. 2 and 3. As another example, the first coil pattern 311 may protrude from one surface of the inner insulation layer 200, the second coil pattern 312 may be embedded in the other surface of the inner insulation layer 200, to expose one surface of the second coil pattern 312 from the other surface of the inner insulation layer 200. In this case, since a recess may be formed in the one surface of the second coil pattern 312, the other surface of the inner insulation layer 200 and the one surface of the second coil pattern 312 may not be located on the same plane. As another example, the second coil pattern 312 may protrude from the other surface of the inner insulation layer 200, and the first coil pattern 311 may be embedded in one surface of the inner insulation layer 200, to expose one surface of the first coil pattern 311 from the one surface of the inner insulation layer 200. In this case, since a recess may be formed in the one surface of the first coil pattern 312, the one surface of the inner insulation layer 200 and the one surface of the first coil pattern 312 may not be located on the same plane.

Each of the coil patterns 311 and 312 and the via 320 may be formed of a conductive material such as copper (Cu), aluminum (Al), silver (Ag), tin (Sn), gold (Au), nickel (Ni), lead (Pb), titanium (Ti), or alloys thereof, but are not limited thereto.

The external electrodes 400 and 500 may be disposed to be spaced from each other on the surface of the body 100, and may be connected to both end portions of the coil portion 300, respectively. In particular, the first external electrode 400 may be disposed on the first surface 101 of the body 100, and may be in contact with and connected to the end portions of the first coil pattern 311 exposed from the first surface 101 of the body 100, and the second external electrode 500 may be disposed on the second surface 102 of the body 100, and may be in contact with and connected the end portions of the second coil pattern 312 exposed from the second surface 102 of the body 100.

The external electrodes 400 and 500 may be formed of a conductive material such as copper (Cu), aluminum (Al), silver (Ag), tin (Sn), gold (Au), nickel (Ni), lead (Pb), chromium (Ti), titanium (Ti), or alloys thereof, but are not limited thereto.

As a non-limiting example, each of the external electrodes 400 and 500 may be formed in a multilayer structure. As an example, each of the external electrodes 400 and 500 may comprise a first layer comprising copper (Cu), a second layer comprising nickel (Ni), and a third layer comprising tin. In this case, the second layer and the third layer may be formed using a plating process, respectively. In forming the second and third layers by a plating process, the above-described plating prevention film 21 may function as a plating resist. The plating prevention film 21 may prevent plating blur or the like in which the second layer and the third layer are extended to regions, except a region in which the external electrodes 400 and 500 are formed in the surface of the body 100.

The insulation film 600 may be formed along the surfaces of the coil patterns 311 and 312, the inner insulation layer 200, and the magnetic core C. The insulation film 600 may be for insulating the coil patterns 311 and 312 from the body 100, and may include a known insulating material such as parylene. An insulating material included in the insulation film 600 may be any insulating material, and is not particularly limited thereto. The insulation film 600 may be formed using a vapor deposition process or the like, but not limited thereto, and may be formed using stacking an insulation film on both surfaces of the inner insulation layer 200.

According to the present disclosure, it is possible to prevent deteriorations of reliability due to plating blur in a plating process for forming external electrodes.

In addition, according to the present disclosure, it is possible for the coil component to become lighter, thinner, shorter, and smaller.

While example embodiments have been illustrated and described above, it will be apparent to those skilled in the art that modifications and variations could be made without departing from the scope of the present disclosure as defined by the appended claims.

What is claimed is:

1. A coil component comprising:

a body comprising magnetic metal powder particles and an insulating resin;

a coil portion embedded in the body; and first and second external electrodes respectively disposed on the body to be spaced apart from each other and respectively connected to both end portions of the coil portion, wherein a magnetic metal powder particle exposed from a surface of the body, among the magnetic metal powder particles, has a plating prevention film disposed on at least a portion of a surface thereof and containing an oxide of at least one element included in the exposed magnetic metal powder particle, and the plating prevention film of the exposed magnetic metal powder particle and a plating prevention film disposed on at least a portion of a surface of another exposed magnetic metal powder particle are discontinuously distributed along the surface of the body.

2. The coil component according to claim 1, wherein the plating prevention film has a crack.

3. A coil component comprising:

a body comprising magnetic metal powder particles and an insulating resin;

a coil portion embedded in the body; and first and second external electrodes respectively disposed on the body to be spaced apart from each other and respectively connected to both end portions of the coil portion, wherein a magnetic metal powder particle exposed from a surface of the body, among the magnetic metal powder particles, has a plating prevention film disposed on at least a portion of a surface thereof and containing an oxide of at least one element included in the exposed magnetic metal powder particle, and a concentration of oxygen in the plating prevention film decreases toward a center of the body.

4. The coil component according to claim 1, wherein the insulating resin has a void.

5. A coil component comprising:

a body comprising magnetic metal powder particles and an insulating resin;

a coil portion embedded in the body; and first and second external electrodes respectively disposed on the body to be spaced apart from each other and respectively connected to both end portions of the coil portion, wherein a magnetic metal powder particle exposed from a surface of the body, among the magnetic metal powder particles, has a plating prevention film disposed on at least a portion of a surface thereof and containing an oxide of at least one element included in the exposed magnetic metal powder particle, the insulating resin has a void, the magnetic metal powder particles comprise a first powder particle, and a second powder particle having a particle diameter smaller than a particle diameter of the first powder particle, and a volume of the void corresponds to a volume of the second powder particle.

6. The coil component according to claim 1, wherein the exposed magnetic metal powder particle has a cut surface, wherein the plating prevention film is disposed on at least a portion of the cut surface.

7. The coil component according to claim 1, wherein a thickness of the plating prevention film is 3 nm or more and 20 μm or less.

8. The coil component according to claim 1, wherein a portion of the plating prevention film is disposed between the exposed magnetic metal powder particle and a portion of the insulating resin.

9. The coil component according to claim 1, wherein each of the first and second external electrodes comprises:

a first metal layer disposed on the surface of the body; and a plating layer disposed on the first metal layer.

10. A coil component comprising:

a body comprising magnetic metal powder particles and an insulating resin;

a coil portion embedded in the body; and first and second external electrodes respectively disposed on the body to be spaced apart from each other and respectively connected to both end portions of the coil portion, wherein a magnetic metal powder particle exposed from a surface of the body, among the magnetic metal powder particles, has a plating prevention film disposed on at least a portion of a surface thereof and containing an oxide of at least one element included in the exposed magnetic metal powder particle, and a thickness of the plating prevention film decreases in a direction from the surface to an inner portion of the body.

11. The coil component according to claim 1, wherein the plating prevention film covers only a portion of the magnetic metal powder particle.

12. A coil component comprising:

a body comprising a magnetic metal powder particle and an insulating resin;

a coil portion embedded in the body; and first and second external electrodes respectively disposed on the body to be spaced apart from each other and respectively connected to both end portions of the coil portion, wherein an oxide film is at least partially disposed in the body and covers only a portion of the magnetic metal powder particle, such that a portion of the oxide film is disposed between the portion of the magnetic metal powder particle and a portion of the insulating resin.

13. The coil component according to claim 12, wherein the oxide film has a crack.

14. The coil component according to claim 12, wherein in the insulating resin has a void having a volume smaller than that of the magnetic metal powder particle.

15. The coil component according to claim 12, wherein the oxide film is an oxide of a metal magnetic component constituting the magnetic metal powder particle.

16. The coil component according to claim 12, wherein the oxide film covers a flat surface of the magnetic metal powder particle.

17. The coil component according to claim 12, wherein a thickness of the oxide film decreases in a direction from a surface of the body to an inner portion of the body.

18. The coil component according to claim 17, wherein the oxide film is spaced apart from the surface of the body.

* * * * *